US006318627B1

(12) United States Patent
Koebbe

(10) Patent No.: US 6,318,627 B1
(45) Date of Patent: Nov. 20, 2001

(54) PUBLICATION VENDING CABINET WITH IMPROVED BALLAST SYSTEM

(76) Inventor: Richard R. Koebbe, 1132 Ferris Rd., P.O. Box 507, Amelia, OH (US) 45102

( * ) Notice: Subject to any disclaimer, the term of this patent is extended or adjusted under 35 U.S.C. 154(b) by 0 days.

(21) Appl. No.: 09/474,641

(22) Filed: Dec. 29, 1999

(51) Int. Cl.[7] ..... B65D 91/00

(52) U.S. Cl. ..... 232/1 C; 232/39; 221/284; 248/346.2

(58) Field of Search ..... 232/1 C, 39, 17, 232/45, 43.1; 221/155, 282, 284; D20/6; 248/346.03, 346.05, 346.2; 312/100, 102

(56) References Cited

U.S. PATENT DOCUMENTS

| | | | | |
|---|---|---|---|---|
| D. 414,515 | | 9/1999 | Berckenhoff et al. . | |
| 3,471,114 | * | 10/1969 | Ball | 248/346.03 |
| 3,863,874 | * | 2/1975 | Pirovano | 248/346.03 |
| 4,239,127 | * | 12/1980 | Owens | 221/259 |
| 4,595,154 | * | 6/1986 | Swope | 248/346.03 |
| 4,919,250 | | 4/1990 | Olson et al. . | |
| 5,356,212 | * | 10/1994 | Okopny | 221/282 |
| 5,452,822 | * | 9/1995 | Haymond | 221/155 |
| 5,582,322 | * | 12/1996 | Prout et al. | 220/771 |
| 5,893,615 | * | 4/1999 | Hendricks et al. | 312/71 |

* cited by examiner

*Primary Examiner*—B. Dayoan
*Assistant Examiner*—William L. Miller
(74) *Attorney, Agent, or Firm*—Jacox, Meckstroth & Jenkins

(57) ABSTRACT

A one-piece upright hollow vending cabinet is formed by rotomolding a thermoplastics material and includes an upper portion supported by an integrally connected lower portion. The upper portion has internal walls defining a first chamber for receiving a stack of paper publications, and a pivotal front door provides access to the chamber and publications. The lower portion of the cabinet defines a second chamber for receiving a flowable ballast material such as sand or gravel, and includes a flared base portion having a bottom wall with an inverted funnel portion. The funnel portion has a top port for pouring the ballast material into the second chamber when the box is inverted, and a removable plug closes the port.

3 Claims, 1 Drawing Sheet

PUBLICATION VENDING CABINET WITH IMPROVED BALLAST SYSTEM

BACKGROUND OF THE INVENTION

The present invention relates to a vending box or cabinet of the general type disclosed in U.S. Pat. No. 4,919,250 and Design No. 414,515 and which are used for vending or dispensing newspapers, magazines or other paper publications. The cabinets are usually free standing on a floor or sidewalk and are sometimes manufactured by rotomolding a thermoplastics material while the material is heated in order to form a one-piece hollow body or cabinet. The cabinet has an upper portion with an inner compartment defining a chamber for receiving a stack of the publications and a lower portion which receives a flowable ballast material such as sand or gravel or water. The ballast material adds substantial weight to the hollow cabinet and prevents the cabinet from being shifted or tilted by a normal external force such as a strong wind.

The ballast material is poured into the lower hollow portion of the cabinet through an opening or port cut into a bottom wall of the inner compartment which encloses the publications. A spring biased pivotal door normally closes a front access opening for the inner compartment for protecting the stack of publications within the compartment. However, it is awkward, time consuming and messy to add the ballast material through the port within the bottom wall of the inner compartment while holding the door in its open position.

SUMMARY OF THE INVENTION

The present invention is directed to an improved vending cabinet for storing and dispensing paper publications and which incorporates a simplified means for conveniently adding a flowable ballast material to a lower portion of the cabinet so that the cabinet will remain upright in response to windstorms and other external forces. In accordance with a preferred embodiment of the invention, a one-piece hollow vending cabinet is formed by rotomolding a heated thermoplastics material to form an upper portion integrally connected to a lower portion having a bottom wall. The upper portion of the cabinet has internal walls forming a first chamber for receiving and storing a stack of paper publications, and a pivotal door provides access to the first chamber. The lower portion of the cabinet defines a second chamber for receiving a flowable ballast material such as sand or gravel or water, and the bottom wall of the lower portion defines an integral inverted funnel portion having an upper end defining an opening or port. When it is desired to add sand or other flowable ballast material to the lower chamber, the housing is tilted or inverted, and an optional closure or plug is removed from the port. The ballast material is poured into the funnel portion and flows into the cabinet. After a desired quantity or volume of ballast material is received within the cabinet with the aid of the funnel portion, the port may be closed with the plastic plug, and the cabinet is returned to its upright position so that the ballast material flows down into the lower or base portion of the cabinet.

Other features and advantages of the invention will be apparent from the following description, the accompanying drawing and the appended claims.

DESCRIPTION OF THE PREFERRED EMBODIMENT

Figure 1:
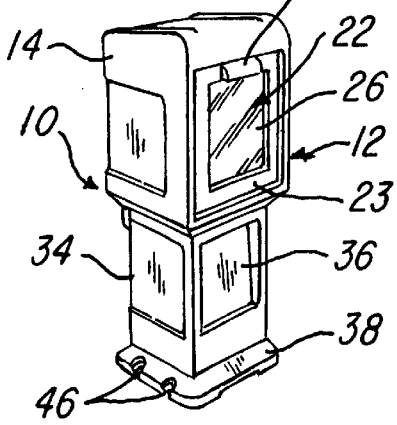
FIG. 1 is a perspective view of an upright publication vending cabinet constructed in accordance with the invention.

FIG. 1 illustrates an upright venting box or cabinet 10 for storing and vending printed publications and which is particularly suited for distributing free paper publications. The cabinet 10 includes a one-piece housing or body 12 which is preferably formed by rotomolding a heated thermoplastics material. The body 12 includes an upper portion 14 having inner walls forming an inner box-like compartment 16 defining a chamber 18 for receiving a stack of the printed paper publications. The chamber 18 is normally closed by a cabinet door 22 having a hollow rectangular frame 23 surrounding a transparent plastic panel 26. The door 22 is pivotally supported by a pair of horizontally aligned trunions 28 located at the bottom of the door, and a twisting or torsion spring (not shown) urges the door from a horizontal open position to a normally closed vertical position, as shown in FIG. 1. A handle 32 at the top of the door 22 provides for tilting the door downwardly to an open position for access to the publications within the chamber 18.

Figure 4:
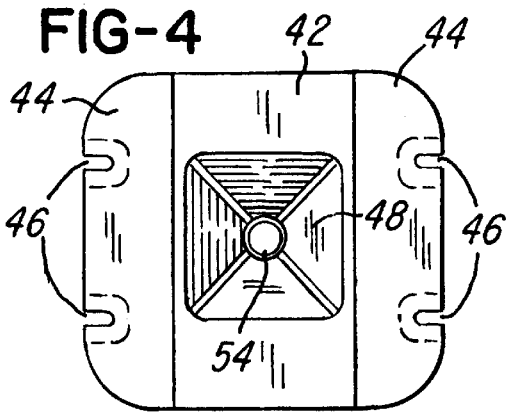
FIG. 4 is a bottom view of the cabinet, as taken generally on the line 4—4 of FIG. 2.

The cabinet body also includes a lower portion 34 which forms an integrally connected stand for supporting the upper portion 14 in an elevated position, and the lower portion 34 has a recessed inclined panel wall 36 for attaching a notice sheet or sample publication. The lower portion 34 includes a flared hollow base portion 38 having a bottom wall 42 forming parallel spaced support surfaces 44 (FIG. 4). Opposite sides of the base portion 38 are provided with recessed slots 46 which are adapted to receive optional anchor bolts for securing the cabinet 10 to a supporting surface such as a floor or sidewalk.

Figure 2:
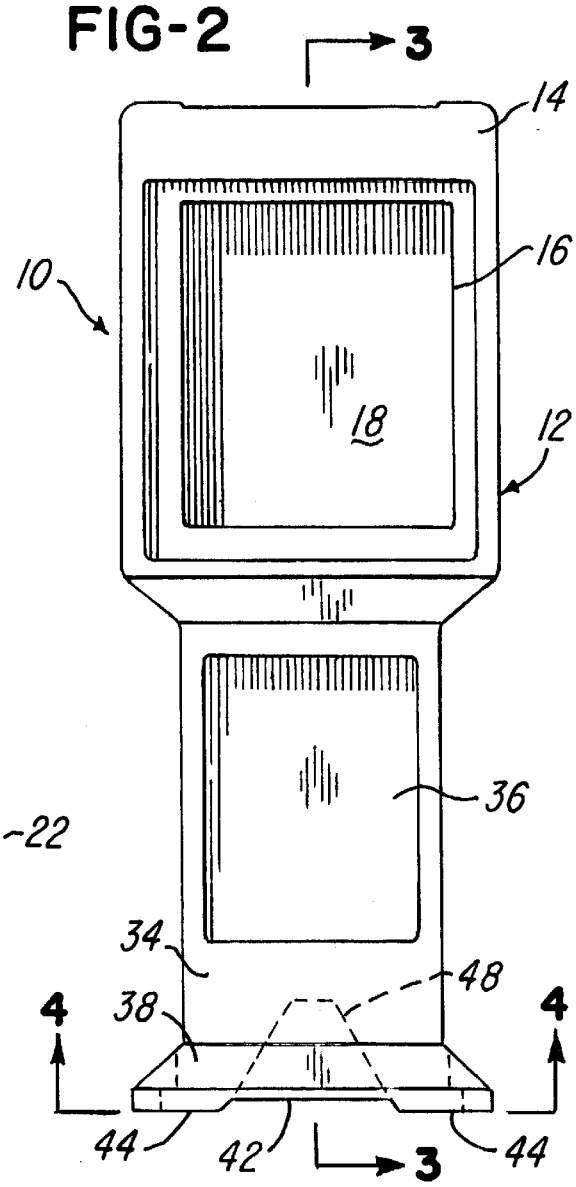
FIG. 2 is a larger front view of the cabinet body shown in FIG. 1.
Figure 3:
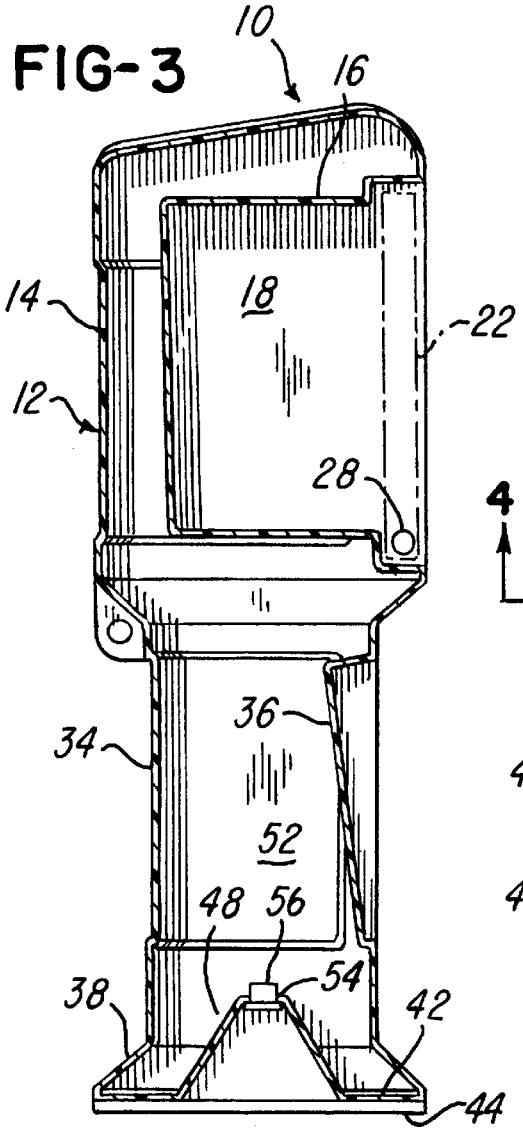
FIG. 3 is a vertical section taken generally on the line 3—3 of FIG. 2.

In accordance with the present invention, the bottom wall 42 of the cabinet is formed with a pyramid-shaped inverted funnel portion 48 which projects upwardly into a chamber 52 defined by the lower portion 34 of the cabinet 10. The inverted funnel portion 48 has a top opening or port 54 which is preferably closed by a removable plastic plug 56. When it is desired to add a flowable ballast material, such as sand or gravel or water, to the lower chamber 52 to provide the cabinet 10 with substantial weight and wind resistance, the cabinet 10 is inverted or tilted to an inclined position, and the plug 56 is removed from the port 54. The ballast material is then poured into the funnel portion 48 and flows through the port 54 until the desired amount of material is received within the chamber 52. The plug 56 is then inserted back into the port 54, and the cabinet is returned to its upright position as shown in FIGS. 1–3. The ballast material flows down into the lower or base portion of the cabinet and settles to a predetermined level such as a level 58 indicated in FIG. 3.

From the drawing and the above description, it is apparent that a publication vending cabinet constructed in accordance with the present invention provides desirable features and advantages. That is, the inverted funnel portion 48 within the bottom wall 42 provides the hollow cabinet 10 with a simple, cleaner and convenient means for adding a flowable ballast material to the lower cabinet chamber 52 without spilling the material onto the surface supporting the Cabinet. The funnel portion 48 may also be rotomolded at the same time the cabinet 10 is rotomolded so that the funnel portion adds no significant cost to the manufacture of the cabinet 10. The inverted funnel portion 48 also assures that the flowable ballast material flows outwardly to the hollow flared base portion 38 of the cabinet when the cabinet is returned to its upright position. As a result, the weight of its ballast material is positioned outwardly within the chamber 52 as far as possible to add greater stability to the cabinet.

While the form of vending cabinet herein described constitutes a preferred embodiment of the invention, it is to be understood that the invention is not limited to this precise form of cabinet, and that changes may be made therein without departing from the scope and spirit of the invention as defined in the appended claims. For example, in place of the funnel portion 48 within the bottom wall 42, a large threaded opening may be formed within or attached to the bottom wall for adding the ballast material, and a screw-in plug or cap may form a removable closure for the opening.

What is claimed is:

1. A vending cabinet for holding and dispensing paper publications, comprising a one-piece vertical cabinet body of molded plastics material, said cabinet body including a lower portion integrally connected to an upper portion, said upper portion of said cabinet body having spaced inner walls defining a first chamber having a front opening for receiving and storing a stack of publications, said lower portion of said cabinet body having a bottom wall and defining a second chamber adapted to receive a flowable ballast material, said bottom wall having an integral inverted funnel portion projecting upwardly into said second chamber generally within a center portion of said cabinet body, said funnel portion having an upper end defining a port for directing the ballast material into said second chamber when said cabinet body is inverted and the ballast material is poured into said funnel portion, and said funnel portion being effective to distribute the ballast material towards the periphery of said bottom wall when said cabinet body is returned to an upright position.

2. A vending cabinet defined in claim 1 wherein said lower portion of said cabinet body includes an outwardly projecting and integral peripheral base portion including said bottom wall, said base portion and said funnel portion define therebetween an annular portion of said second chamber for receiving the ballast material, and a removable closure for said port.

3. A vending cabinet as defined in claim 1 wherein said funnel portion has generally the shape of a pyramid.

* * * * *